US005478090A

United States Patent [19]

Simmons et al.

[11] Patent Number: 5,478,090

[45] Date of Patent: Dec. 26, 1995

[54] INTERLOCKED SEAL AND SLEEVE FOR ROLLING MILL OIL FILM BEARING

[75] Inventors: Thomas E. Simmons, Westborough; Charles L. Innis, Jr., Paxton, both of Mass.

[73] Assignee: Morgan Construction Company, Worcester, Mass.

[21] Appl. No.: 78,731

[22] Filed: Jun. 16, 1993

[51] Int. Cl.[6] ..... F16J 15/34; F02F 11/00; F02F 5/00

[52] U.S. Cl. ..... 277/95; 277/164; 277/168; 277/53; 277/55; 277/56; 277/152; 277/153

[58] Field of Search ..... 277/188 R, 191, 277/190, 199, 181, 228, 167.3, 164, 53, 54, 55, 56, 152, 153, 164, 95, 168

[56] References Cited

U.S. PATENT DOCUMENTS

| | | | |
|---|---|---|---|
| 1,366,219 | 1/1921 | Sudekum | 277/199 |
| 2,555,647 | 6/1951 | King | 277/199 |
| 2,955,001 | 10/1960 | Rich | 308/36.1 |
| 3,330,567 | 7/1967 | Mercer et al. | 277/164 |
| 3,479,840 | 11/1969 | Meyers | 277/65 |
| 3,833,273 | 9/1974 | Rickley et al. | 277/56 |
| 4,165,881 | 8/1979 | Salter | 277/152 |
| 4,234,196 | 11/1980 | Iida | 277/12 |
| 4,256,316 | 3/1981 | Reinsma | 277/95 |
| 4,435,096 | 3/1984 | Petros | 277/95 |
| 4,866,827 | 9/1989 | Benfer et al. | 277/152 |
| 4,987,826 | 1/1991 | Deppert et al. | 277/188 R |

FOREIGN PATENT DOCUMENTS

| | | | |
|---|---|---|---|
| 2929033 | 1/1980 | Germany | F16C 13/02 |
| 2076481 | 12/1981 | United Kingdom | 277/152 |

*Primary Examiner*—William A. Cuchlinski, Jr.
*Assistant Examiner*—Keith Hwang
*Attorney, Agent, or Firm*—Samuels, Gauthier & Stevens

[57] ABSTRACT

In an oil film bearing assembly for a roll in a rolling mill, where a flexible seal is mounted on a tapered section of the roll neck at a location adjacent to a sleeve fixed to the roll neck and defining the journal surface, the improvement comprising an end portion of the sleeve being configured to overlap and radially confine an end portion of the seal to thereby resist centrifugal distortion of the seal during high speed rotation of the roll neck.

14 Claims, 1 Drawing Sheet

INTERLOCKED SEAL AND SLEEVE FOR ROLLING MILL OIL FILM BEARING

BACKGROUND OF THE INVENTION

1. Field of the Invention

This invention relates generally to oil film bearings and neck seals for rolls in a rolling mill, and is concerned in particular with an improved means for resisting centrifugal seal distortion.

2. Description of the Prior Art

Typical rolling mill oil film bearings and neck seals are disclosed in U.S. Pat. Nos. 4,165,881 and 4,586,720. In these arrangements, the flexible neck seals are subjected to centrifugal forces tending to pull them away from the tapered sections of the roll necks on which they are mounted. Over the years, embedded and/or externally applied metallic reinforcements have been added to the seal bodies to resist centrifugal distortion.

A primary objective of the present invention is to further improve upon the ability of the neck seals to withstand centrifugal forces.

A companion objective of the present invention is to resist centrifugal distortion of the neck seals without resort to additional embedded and/or externally applied metallic reinforcements.

SUMMARY OF THE INVENTION

In preferred embodiments of the invention to be hereinafter described in greater detail, these and other objectives and advantages of the present invention are achieved by reconfiguring the adjacent ends of the neck seal body and the roll neck sleeve to establish an overlapping interlock between the two, resulting in the seal end being radially confined within the sleeve end. This radial confinement significantly increases resistance to centrifugal seal deformation, without the necessity of having to resort to additional embedded or externally applied reinforcements.

DETAILED DESCRIPTION OF ILLUSTRATED EMBODIMENTS

Figure 1:
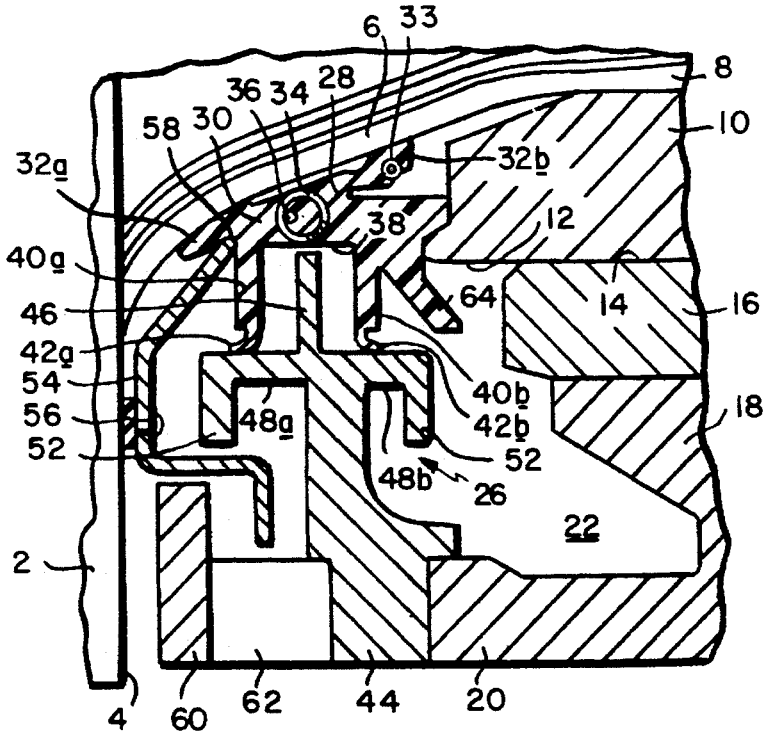
FIG. 1 is a partial cross sectional view of a seal assembly in accordance with one embodiment of the invention.
Figure 2:
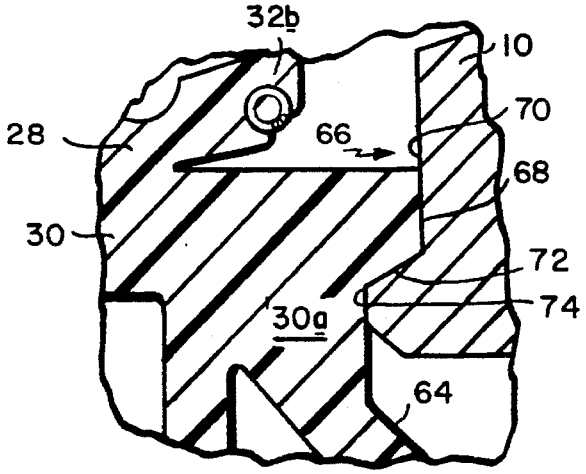
FIG. 2 is an enlarged view of a portion of FIG. 1.

Referring now to the drawings, and with initial reference to FIGS. 1 and 2, there is shown at 2 a roll having an end face 4 and a roll neck with a tapered intermediate section 6 leading to a more gradually tapered end section 8. A sleeve 10 is mounted on the tapered end section 8 and is fixed relative to the roll neck by conventional means (not shown) for rotation therewith. The sleeve 10 has an outer bearing surface 12 which is journalled for rotation within an interior bearing surface 14 of a fixed bushing 16 which is carried in a roll chock 18. The sleeve 10 rotates with the roll while the roll chock 18 and the fixed bushing 16 remain stationary. Oil in sufficient quantity to support a hydrodynamically created film between surfaces 12, 14 is fed continuously between the bearing surfaces 12 and 14. A circular extension 20 of the roll chock provides at its bottom portion a sump 22 in which the oil emerging from the beating is continuously collected.

The oil may be drawn away from the sump through a suitable piping connection (not shown) to be recycled back to the bearing surfaces.

Where the roll 2 is operating under "wet" conditions, coolant fluid is constantly flooding over the roll 2 and down over the end face 4. In spite of the centrifugal forces which tend to throw the coolant off of the roll, some of the coolant tends to work its way along the roll neck in the direction of the bearing. The objective of the seal assembly generally indicated at 26 and the flexible neck seal 28 which forms a part of the bearing assembly, is to prevent any of the coolant fluid from reaching and contaminating the bearing oil and, vice versa, preventing loss of oil from the bearing.

The flexible neck seal 28 includes a flexible circular seal body 30 with lips 32*a*, 32*b* in sealing engagement with the tapered section 6 of the roll neck. The neck seal 28 is molded of a suitable resilient rubber-like material. Preferably, the seal body 30 is internally reinforced by an embedded combination of a coiled spring 34 and a steel cable 36 as described in U.S. Pat. No. 3,330,567. Lip 32*b* is also radially constrained by an external spring 33.

The seal body 30 has an exterior cylindrical surface 38 which is parallel to the rotational axis of the roll 2 when the neck seal is in its mounted position as shown in FIG. 1. A pair of axially spaced circular flexible flanges 40*a*, 40*b* are integral with and extend radially outwardly from the seal body 30 at opposite ends of the exterior cylindrical surface 38. The flanges 40*a*, 40*b* are advantageously provided with flexible lips 42*a*, 42*b*.

The seal assembly also includes a rigid circular seal end plate 44 which is mounted on the roll chock 18. The seal end plate has a radially inwardly extending rigid flange 46 which is perpendicular to the rotational axis of the roll 2. The inner edge of flange 46 is spaced radially from the exterior cylindrical surface 38 on the flexible seal body. The seal end plate 44 further includes shoulders 48*a*, 48*b* extending in opposite directions from the base of the rigid flange 46. The shoulders 48*a*, 48*b* surround the flexible seal flanges 40*a*, 40*b* and are arranged to be slidingly contacted by the flexible lips 42*a*, 42*b*.

The seal assembly 26 further includes additional flanges 52 extending radially outwardly from the shoulders 48*a*, 48*b* of the seal end plate, a seal inner ring 54 optionally having resilient buttons 56 engaging the end face 4 of the roll, with the inner edge of the seal inner ring contacting the flexible seal body as at 58, and a seal outer ring 60 surrounding the seal inner ring 54 and having a drainage port 62 extending through its lower side.

During a rolling operation, the above-described apparatus will operate in the following manner: the seal inner ring 54, flexible neck seal 28 and sleeve 10 will rotate with the roll neck. The seal outer ring 60, seal end plate 44, chock 18 and bushing 16 will remain stationary. Lubricating oil will constantly flow from between the bearing surfaces 12 and 14. Most of this oil will be turned back by a rotating flinger 64 on the neck seal 28 and will thus be directed to the sump 22. Oil which succeeds in passing by the ringer 64 will be turned back by the rotating flange 40*b* and will be prevented from escaping between the flange 40*b* and the shoulder surface 50 by the flexible lip 42*b* which sealingly engages the shoulder surface 50. Likewise, the major portion of the coolant applied to the roll 2 will be turned back by the rotating inner seal ring 54. Any coolant which succeeds in passing by the seal inner ring 54 will be turned back by the rotating flange 40*a* on the neck seal 28 and will be prevented from passing between the flange 40*a* and its surrounding shoulder 48*a* by the flexible lip 42*a*.

As the roll neck rotates, there will be a tendency for the neck seal 28 to centrifugally deform. Such deformation is resisted by the internal reinforcements 34, 36, and by the external spring 33 surrounding lip 32*b*. External reinforcements in the form of metal bands (not shown) also may be applied to exterior cylindrical surface 38 of the seal body.

Such added reinforcements do not, however, effectively resist the tendency of the outboard body portion 30*a* of the seal, including the integral ringer 64, to pull away from the roll neck. The present invention addresses this problem by configuring the outboard end portion of the seal body to be overlapped by and to thus be radially confined within an inboard end portion of the sleeve 10. Preferably, this is achieved by providing the end face of the sleeve with a circular recess 66 into which a circular end shoulder 68 of the sleeve is axially received.

Figure 3:
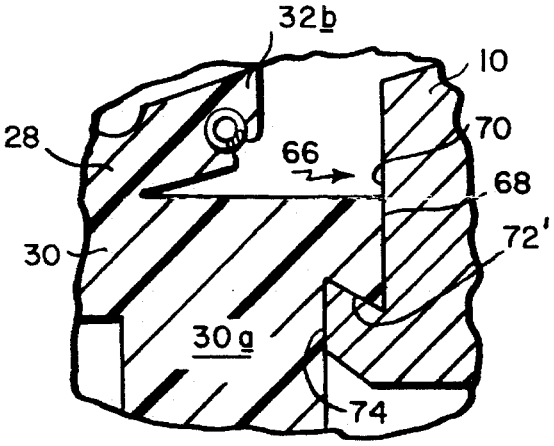
FIGS. 3 and 4 are illustrations similar to FIG. 2 showing alternative embodiments.
Figure 4:
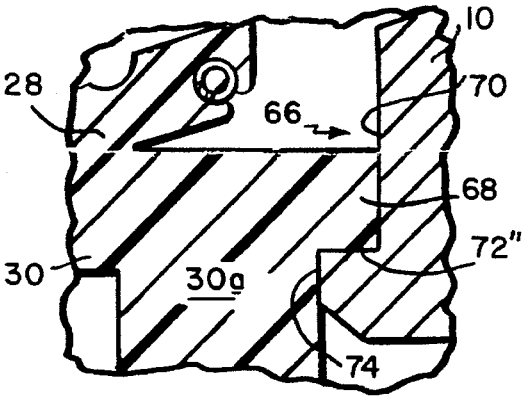

In the embodiment shown in FIGS. 1 and 2, the shoulder has an end face contacting the recess bottom 70, and an outer surface contacting a wall of the recess along an interface 72 tapered in the same direction as the taper of the roll neck section 6. FIG. 3 shows an alterative embodiment where the interface 72' is tapered in a direction opposite to the taper of roll neck section 6. In FIG. 4, the interface 72" is cylindrical.

In each of the embodiments herein disclosed, the sleeve shoulder 68 is overlapped by and thus radially interlocked with the inboard end of the sleeve 10. This resists any tendency of the outboard end of the seal to centrifugally distort. The interface taper illustrated in FIGS. 1 and 2 is preferred because it provides a lead-in during mounting of the bearing assembly on the roll neck, which is particularly desirable when the seal may have become separated from the sleeve. The end of the sleeve always presses against the seal as at 74, and centrifugal forces experienced during high speed rotation will create a stabilizing wedging action between the sleeve and seal.

The reverse interface taper of FIG. 3 establishes an axial interlock between the seal and sleeve, thereby encouraging these components to remain assembled during mounting and demounting of the bearing assembly.

We claim:

1. In an oil film bearing assembly for a roll in a rolling mill, said roll having a neck with an intermediate tapered section leading to a reduced diameter end section contained within a sleeve, the sleeve being fixed in relation to the roll neck and being journalled for rotation in a bushing fixed within a bearing chock, a seal adapted to be mounted on said taper section for rotation therewith at a location surrounded by a seal end plate fixed in relation to said chock, said seal comprising a flexible seal body having resilient lips in sealing contact with said tapered section and radial flanges in sealing contact with said seal end plate, an end portion of said seal flexible body being spaced radially outwardly from the tapered section of said roll neck and being overlapped by and radially inwardly confined within an end portion of said sleeve.

2. The seal of claim 1 further comprising a circular shoulder at an end of said seal body, said circular shoulder protruding axially into a circular recess in an adjacent end of said sleeve.

3. The seal of claim 1 wherein the end portion of said seal body is radially confined by the end portion of said sleeve along a tapered interface.

4. The seal of claim 3 wherein said interface is tapered in the same direction as the intermediate tapered section of said roll neck.

5. The seal of claim 3 wherein said interface is tapered oppositely with respect to the direction of taper of the intermediate section of said roll neck.

6. The seal of claim 1 wherein the end portion of said seal body is radially confined by the end portion of said sleeve along a cylindrical interface.

7. The seal of claim 2 wherein said shoulder has an end face and a contact surface disposed angularly with respect to said end face, said end face and said contact surface being adapted to coact in mutual contact respectively with the bottom and one side of said circular recess.

8. In an oil film bearing assembly for a roll in a rolling mill, said roll having a neck with an intermediate tapered section leading to a reduced diameter end section contained within a sleeve, the sleeve being fixed in relation to the roll neck and being journalled for rotation in a bushing fixed within a bearing chock, with a seal mounted on said tapered section for rotation therewith at a location surrounded by a seal end plate fixed in relation to said chock, said seal having a flexible seal body with resilient lips in sealing contact with said tapered section and radial flanges in sealing contact with said seal end plate, an end portion of said flexible seal body being spaced radially outwardly from said tapered section, the improvement comprising an end of said sleeve being configured to overlap and radially confine the said end portion of said seal body.

9. The oil film bearing assembly of claim 8 wherein said sleeve has an end face with a circular recess therein, the end portion of said seal body being received in said recess.

10. The oil film beating assembly of claim 9 wherein the end portion of said seal body has a contact surface radially confined by a side of said recess along a mutual interface surrounding the rotational axis of said sleeve.

11. The oil film bearing assembly of claim 10 wherein said interface is tapered.

12. The oil film bearing assembly of claim 11 wherein said interface is tapered in the direction of taper of the intermediate section of said roll neck.

13. The oil film bearing assembly of claim 11 wherein said interface is tapered a direction opposite to the direction of taper of the intermediate section of said roll neck.

14. The oil film bearing assembly according to any one of claims 9–13 wherein the bottom of said recess is in contact with an end face on said seal body.

* * * * *